US005492307A

United States Patent [19]

Begue, Jr. et al.

[11] Patent Number: 5,492,307

[45] Date of Patent: Feb. 20, 1996

[54] MODULAR FENCE APPARATUS

[76] Inventors: Sheldon L. Begue, Jr., 958 Rossmore La., Baton Rouge, La. 70810; Brent Rabalais, 11816 Spring Meadow Rd., Baton Rouge, La. 70818

[21] Appl. No.: 225,337

[22] Filed: Apr. 8, 1994

[51] Int. Cl.[6] ..... E04H 17/14

[52] U.S. Cl. ..... 256/19; 256/24; 256/66

[58] Field of Search ..... 256/19, 24, 27, 256/65, 59, 69, 68, 66, 73, DIG. 5, 21–22, 1; 47/33

[56] References Cited

U.S. PATENT DOCUMENTS

| | | | |
|---|---|---|---|
| 2,918,261 | 12/1959 | Bergeron | 256/19 X |
| 3,254,464 | 6/1966 | Hoyt, Jr. | 256/19 X |
| 3,801,072 | 4/1974 | Newberry, Jr. | 256/19 |
| 3,892,387 | 7/1975 | Mann | 256/19 X |
| 3,933,311 | 1/1976 | Lemelson | 47/33 X |
| 4,070,007 | 1/1978 | Minor et al. . | |
| 4,074,893 | 2/1978 | Coltrin | 256/21 |
| 4,357,000 | 11/1982 | Tisbo et al. . | |
| 4,369,953 | 1/1983 | Greiner et al. | 256/24 |
| 4,477,058 | 10/1984 | Lowery . | |
| 4,540,160 | 9/1985 | Zanavich et al. | 256/19 |
| 4,553,741 | 11/1985 | Creasy et al. . | |
| 4,722,514 | 2/1988 | Pettit . | |
| 5,215,290 | 6/1993 | Khalessi | 256/19 |

FOREIGN PATENT DOCUMENTS

| | | | |
|---|---|---|---|
| 2094849 | 9/1982 | United Kingdom | 256/73 |

*Primary Examiner*—Blair M. Johnson
*Assistant Examiner*—Harry C. Kim

[57] ABSTRACT

A new and improved fence apparatus includes a plurality of hollow fence modules which are made of plastic material, which include ornamental exterior surfaces, and which slots at their edge portions. The slots are adapted to receive connector elements. A plurality of joint assemblies are adapted to be interconnected between two hollow fence modules placed edge to edge. The joint assemblies include connector elements adapted to be received in the slots of the two hollow fence modules for joining the fence modules together. The connector elements also fit into slots in the joint assemblies. Fence post assemblies are connected to the hollow fence modules for securing the hollow fence modules to a portion of the ground. The connector elements include first channels. The edge portions of the hollow fence modules include second channels which are capable of being placed in registration with the first channels. Fasteners are placed through the registered first channels and the second channels and are employed to secure the hollow fence modules to the joint assemblies. The joint assemblies include right-angled corner joint assemblies and straight-angled straight joint assemblies. The ornamental exterior surface may simulate vertically oriented wooden boards, a brick wall, or a picket fence. The fence post assemblies may include metal posts that are placed external to the hollow fence modules, either as independent fence posts or contained within joint assemblies. Alternatively, the fence post assemblies are contained internally within a hollow interior of the hollow fence modules.

8 Claims, 4 Drawing Sheets

MODULAR FENCE APPARATUS

BACKGROUND OF THE INVENTION

1. Field of the Invention

The present invention relates generally to fences and, more particularly, to fences having modular components.

2. Description of the Prior Art

Fences are generally comprised of individual horizontal components and individual vertical components. Certain types of fences known as privacy fences require many closely placed individual components to be placed adjacent to each other to prevent a person from outside the fenced property from seeing inside the fenced property. Installation of large numbers of individual fence components require large amounts of time and labor. In this respect, it would be desirable if a fence apparatus were provided which did not require the installation of large numbers of closely spaced individual components.

Privacy fences are often comprised of large numbers of adjacent vertically oriented boards. The boards are generally made of wood which is subject to swelling and shrinking due to moisture and temperature changes. As a result, spaces may be created between adjacent boards. When this is the case, the degree of privacy that the fence establishes may be severely compromised. In this respect, it would be desirable if a fence apparatus were provided which is not made of wood and is not subjected to swelling and shrinking due to moisture and temperature changes such that the privacy established by a privacy fence is not compromised.

Aside from the use of vertically oriented boards for providing a privacy fence, a privacy fence may be made from other materials such as brick. Building of a brick privacy fence is more time-consuming and expensive than building a wooden fence. A privacy fence need not have substantial structural strength because it does not support other structures such as a roof of a building. As a result, a privacy fence can be made of a material that merely simulates brick or wood. In this respect, it would be desirable if a fence apparatus were provided which is made of a material other than wood or brick but simulates the appearance of wood or brick.

Wood and brick are materials that are solid throughout. Yet for a simulated wood or brick surface, it is not necessary that the material forming the simulated wood or brick surface be solid throughout. More specifically, to reduce costs of materials it would be desirable if a simulated privacy fence were made from hollow materials that had a simulated wood or simulated brick outer surface.

In general, any fence apparatus includes two major components. The first are vertical fence posts that are driven into the ground. The second are boards that extend horizontally between vertical fence posts. For proper fence integrity, it is important that the connections between the vertical fence posts and the horizontally extending boards be secure. To establish secure connections between the vertical fence posts and the horizontal boards, a variety of connection devices may be used. However, aside from establishing secure connections between the vertical fence posts and the horizontal boards, the connection devices should not detract from the aesthetic appearance of the fence. Unfortunately, connection devices are overt and obvious and do detract from the aesthetic appearance of the fence. To reduce the negative effects on aesthetics, it would be desirable if the connection devices between the vertical fence posts and the horizontal boards substantially hidden and not in view.

As stated above, privacy fences often employ a large number of vertically oriented boards. Generally, several horizontal rails extend between vertically oriented fence posts, and a large number of vertically oriented boards are nailed to the horizontally oriented rails. To save a lot of time and effort and to preclude the need to nail a large number of vertically oriented boards onto horizontally oriented rails, it would be desirable if a fence apparatus were provided which used only a relatively small number of vertically oriented fence posts yet gave the appearance of employing a large number of vertically oriented boards.

Throughout the years, a number of innovations have been developed relating to fence apparatuses, and the following U.S. patents are representative of some of those innovations: U.S. Pat. Nos. 4,070,007; 4,357,000; 4,477,058; 4,553,741; and 4,722,514. More specifically, U.S. Pat. No. 4,070,007 discloses plastic fence posts that have lugs for supporting wires.

U.S. Pat. No. 4,357,000 discloses a molded plastic fence section that employs a complex E-shaped formation on one fence section and a complex F-shaped formation of a complementary fence section. Moreover, the interconnection between the E-shaped and the F-shaped formations is visible and may disturb aesthetic sensibilities.

U.S. Pat. No. 4,477,058 discloses a plastic fence that employs a large number of independent, vertically oriented plastic board-like elements that are independently supported by three horizontally oriented rails. Each of the rails has horizontally protruding pegs that are snapped into either a hole or a slot in a vertically oriented board. Generally, it may be stated that each vertically oriented board is connected independently to a plurality of horizontal rails. For purposes of simplicity and economy, it would be desirable to eliminate a plurality of horizontal rails for supporting a plurality of vertical boards.

Each of U.S. Pat. Nos. 4,553,741 and 4,722,514 discloses a plastic fence assembly that employs a plastic vertical fence post and plastic horizontal rails. The fence post has slots for receiving the horizontal rails. A horizontal rail may readily fit into a side slot on a vertical fence post. However, a vertical board in a privacy fence is not oriented so as to fit into a side slot on a vertical fence post. In this respect, it would be desirable if a fence apparatus were provided which facilitated connection of a vertical board to a vertical fence post.

Still other features would be desirable in a fence apparatus. For example, aside from privacy fences, it would be desirable if components of a modular fence apparatus could be used as walls of a utility shed. Such a utility shed could be produced without requiring the installation of large numbers of closely spaced individual components, without being made of wood, without being subjected to swelling and shrinking due to moisture and temperature changes, being made of a material other than wood or brick but simulating the appearance of wood or brick, and being made from hollow materials that had a simulated wood or simulated brick outer surface.

In addition, aside from privacy fences, it would be desirable if components of a modular fence apparatus could be used in the building of picket fences.

Thus, while the foregoing body of prior art indicates it to be well known to use fences which include plastic materials, the prior art described above does not teach or suggest a modular fence apparatus which has the following combination of desirable features: (1) does not require the installation of large numbers of closely spaced individual components; (2) is not made of wood and is not subjected to swelling and shrinking due to moisture and temperature changes such that the privacy established by a privacy fence is not compromised; (3) is made of a material other than wood or brick but simulates the appearance of wood or brick; (4) is made from hollow materials that have a simulated wood or simulated brick outer surface; (5) employs connection devices between the vertical fence posts and the horizontal boards that are substantially hidden from view; (6) uses only a relatively small number of vertically oriented fence posts yet gives the appearance of employing a large number of vertically oriented boards; (7) eliminates a plurality of horizontal rails for supporting a plurality of vertical boards; (8) facilitates connection of a vertical board to a vertical fence post; (9) provides components of a modular fence apparatus that can be used as walls of a utility shed; and (10) provides components of a modular fence apparatus can be used in the building of picket fences. The foregoing desired characteristics are provided by the unique modular fence apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved fence apparatus which includes a plurality of hollow fence modules made of plastic material. The hollow fence modules include an ornamental exterior surface. The hollow fence modules include slots, at edge portions of the hollow fence modules. The slots are adapted to receive connector elements. A plurality of joint assemblies are adapted to be interconnected between two hollow fence modules. The joint assemblies include connector elements adapted to be received in the slots of the two hollow fence modules for joining the two hollow fence modules together. The connector elements fit into slots in the joint assemblies. A plurality of fence post assemblies are connected to the hollow fence modules for securing the hollow fence modules to a portion of the ground.

As stated above, the connector elements are adapted to be received in slots of the hollow fence modules and in slots of the joint assemblies. The connector elements include first channels. The edge portions of the hollow fence modules include second channels which are capable of being placed in registration with the first channels. Fasteners are placed through the registered first channels and the second channels and are employed to secure the hollow fence modules to the joint assemblies.

The joint assemblies may include corner joint assemblies in which connector elements project from a first side of the corner joint assemblies at a right angle with respect to connector elements which project from a second side of the corner joint assemblies. Alternatively, the joint assemblies include straight joint assemblies in which connector elements project from a first side of the straight joint assemblies at a straight angle with respect to connector elements which project from a second side of the straight joint assemblies.

The ornamental exterior surface may simulate vertically oriented wooden boards, a brick wall, or a picket fence. The fence post assemblies may include metal posts that are placed external to the hollow fence modules, either as independent fence posts or contained within joint assemblies. Alternatively, the fence post assemblies are contained internally within a hollow interior of the hollow fence modules.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved modular fence apparatus which has all of the advantages of the prior art and none of the disadvantages.

It is another object of the present invention to provide a new and improved modular fence apparatus which may be easily and efficiently manufactured and marketed.

It is a further object of the present invention to provide a new and improved modular fence apparatus which is of durable and reliable construction.

An even further object of the present invention is to provide a new and improved modular fence apparatus which is susceptible of a low cost of manufacture with regard to both materials and labor, and which accordingly is then susceptible of low prices of sale to the consuming public, thereby making such modular fence apparatus available to the buying public.

Still yet a further object of the present invention is to provide a new and improved modular fence apparatus which does not require the installation of large numbers of closely spaced individual components.

Still another object of the present invention is to provide a new and improved modular fence apparatus that is not made of wood and is not subjected to swelling and shrinking due to moisture and temperature changes such that the privacy established by a privacy fence is not compromised.

Yet another object of the present invention is to provide a new and improved modular fence apparatus which is made of a material other than wood or brick but simulates the appearance of wood or brick.

Even another object of the present invention is to provide a new and improved modular fence apparatus that is made from hollow materials that have a simulated wood or simulated brick outer surface.

Still a further object of the present invention is to provide a new and improved modular fence apparatus which employs connection devices between the vertical fence posts and the horizontal boards that are substantially hidden from view.

Yet another object of the present invention is to provide a new and improved modular fence apparatus that uses only a relatively small number of vertically oriented fence posts yet gives the appearance of employing a large number of vertically oriented boards.

Still another object of the present invention is to provide a new and improved modular fence apparatus which eliminates a plurality of horizontal rails for supporting a plurality of vertical boards.

Yet another object of the present invention is to provide a new and improved modular fence apparatus that facilitates connection of a vertical board to a vertical fence post.

Still a further object of the present invention is to provide a new and improved modular fence apparatus that provides components of a modular fence apparatus that can be used as walls of a utility shed.

Yet another object of the present invention is to provide a new and improved modular fence apparatus which provides components of a modular fence apparatus can be used in the building of picket fences.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved modular fence apparatus embodying the principles and concepts of the present invention will be described.

Figure 1:
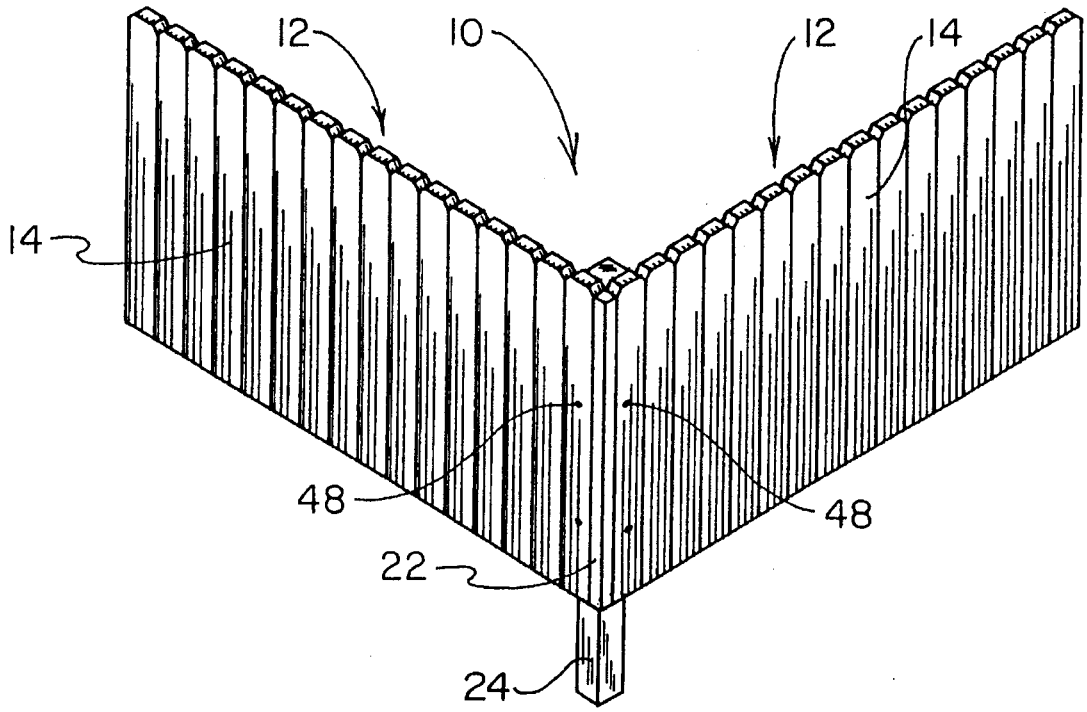
FIG. 1 is a perspective view showing a first preferred embodiment of the modular fence apparatus of the invention wherein two fence modules in the form of simulated vertically oriented wooden boards are joined at a corner joint unit and wherein exterior fence posts are used to secure the fence modules to the ground.
Figure 2:
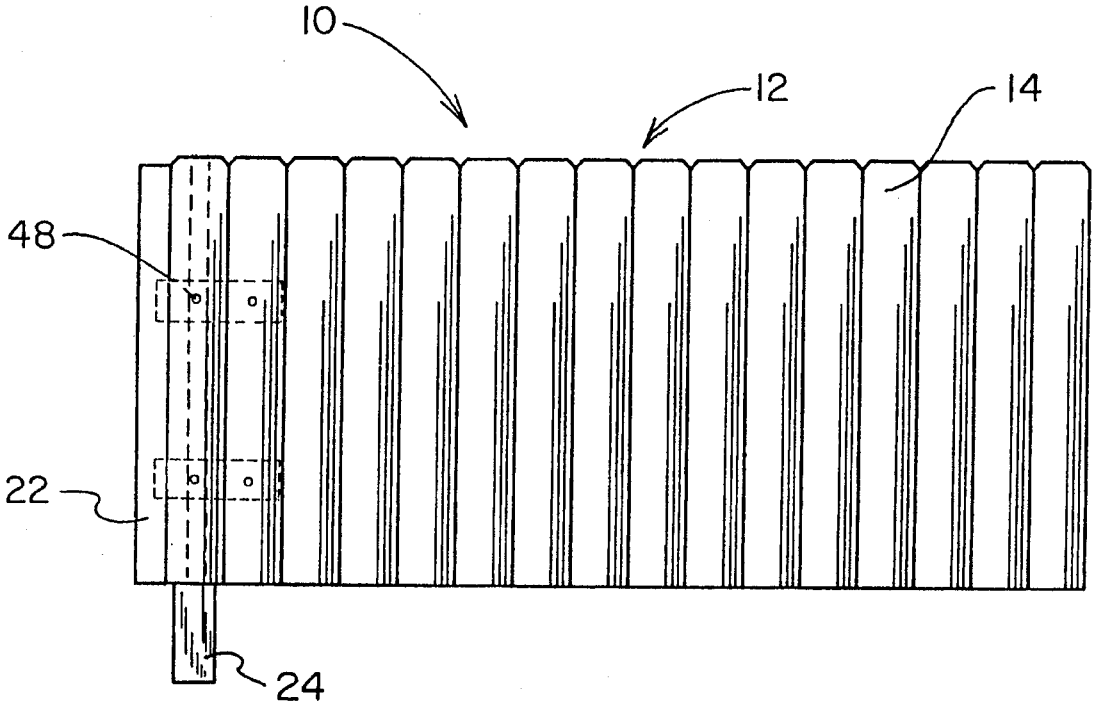
FIG. 2 is an enlarged side view of one simulated wooden fence module, a corner joint unit, and an exterior fence post of the embodiment of the modular fence apparatus shown in FIG. 1.
Figure 3:
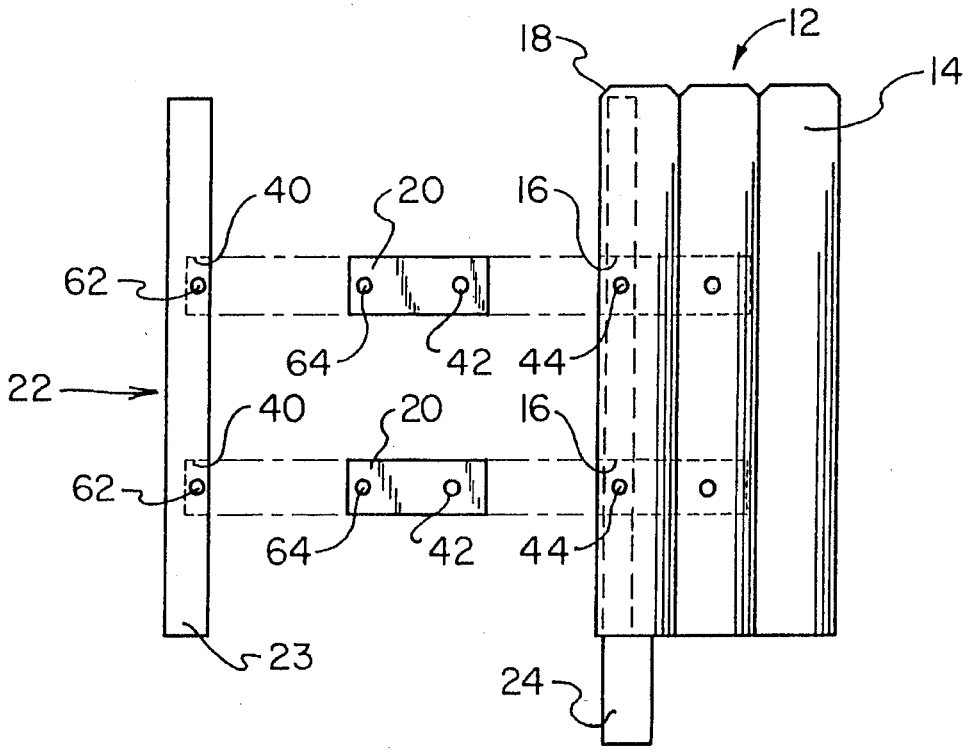
FIG. 3 is an enlarged, partially exploded side view of a portion of the embodiment of the invention shown in FIG. 2 showing connector assemblies for connecting the corner joint unit to the simulated wood fence module.
Figure 5:
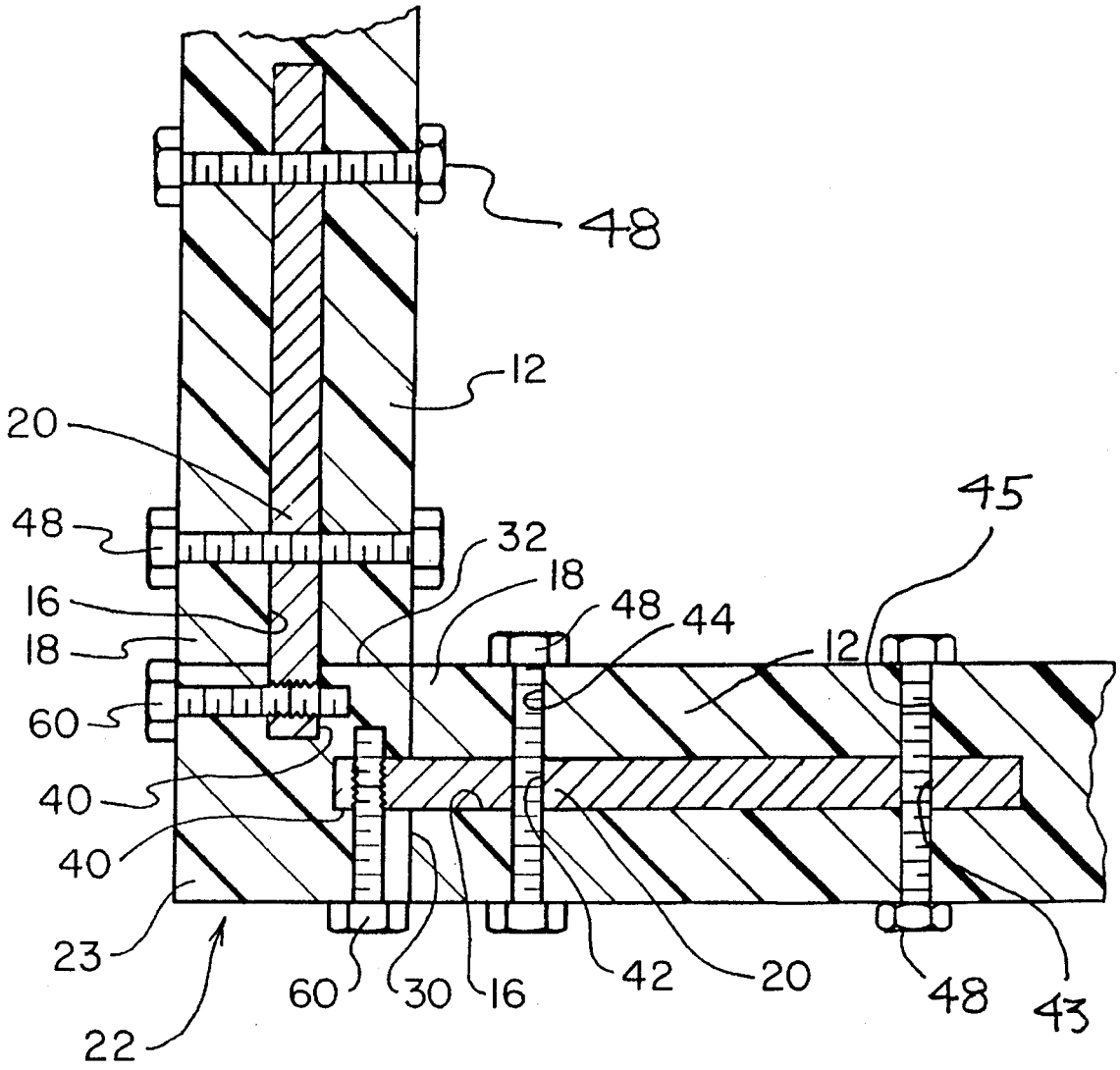
FIG. 5 is an enlarged cross-sectional view of the embodiment of the invention shown in FIG. 4 taken along line 5—5 of FIG. 4 showing connector assemblies for connecting the fence modules to the combined corner joint/fence post.

Turning to FIGS. 1–3, there is shown a first exemplary embodiment of the modular fence apparatus of the invention generally designated by reference numeral 10. In this preferred form, modular fence apparatus 10 includes a plurality of hollow fence modules 12 made of plastic material. The hollow fence modules 12 include an ornamental exterior surface 14. The hollow fence modules 12 include slots 16 (as shown in FIG. 5) at edge portions 18 of the hollow fence modules 12. The slots 16 are adapted to receive connector elements 20.

A plurality of joint assemblies 22 are adapted to be interconnected between two hollow fence modules 12. The joint assemblies 22 include connector elements 20 adapted to be received in the slots 16 of the two hollow fence modules 12 for joining the two hollow fence modules 12 together.

A plurality of fence post assemblies 24 are connected to the hollow fence modules 12 for securing the hollow fence modules 12 to a portion of the ground 28. The fence post assemblies 24 preferably have a square transverse cross-section and are long enough so that the bottom portions thereof extending below the bottom edge of the hollow fence modules may be anchored in a concrete footing in the ground (not shown). The connector elements 20 fit into slots 40 in the joint assemblies 22. Additional channels 62 are present in the joint assemblies 22, and additional channels 64 are present in the connector elements 20 to permit additional fasteners 60 to be placed through those additional channels to secure the connector elements 20 to the joint assemblies 22.

As shown in FIG. 5, the connector elements 20 are adapted to be received in slots 16 of the hollow fence modules 12 and in slots 40 of the joint assemblies 22; and the connector elements 20 include first channels 42 and second channels 43 spaced longitudinally from the first channels substantially as shown. The edge portions 18 of the hollow fence modules 12 include third and fourth channels 44 and 45 which are capable of being placed in registration with the first channels 42 and second channels 43. Fasteners 48 are placed through the registered channels 42, 44 and 43, 45, respectively, and are employed to secure the hollow fence modules 12 to the joint assemblies 22.

As shown in FIGS. 1 and 5, the joint assemblies 22 include corner joint assemblies 23 in which connector elements 20 project from a first side 30 of the corner joint assemblies 23 at a right angle with respect to connector elements 20 which project from a second side 32 of the corner joint assemblies 23. The fasteners 60 which extend through suitable corresponding channels in the fence post are engaged with the distal ends of the connector elements 20 extending into suitable corresponding channels in the fence post. Preferably, each fastener 60 comprises a male threaded bolt adapted to mate with a complimentary threaded female aperture in the distal end of the connector element. It will be noted that the connector elements 20 preferably have a longitudinal extent long enough to span at least two fence boards in either orthogonal direction with respect to the ends 30, 32 of the fence post as shown to good advantage, for example, in FIGS. 2 and 7.

Figure 4:
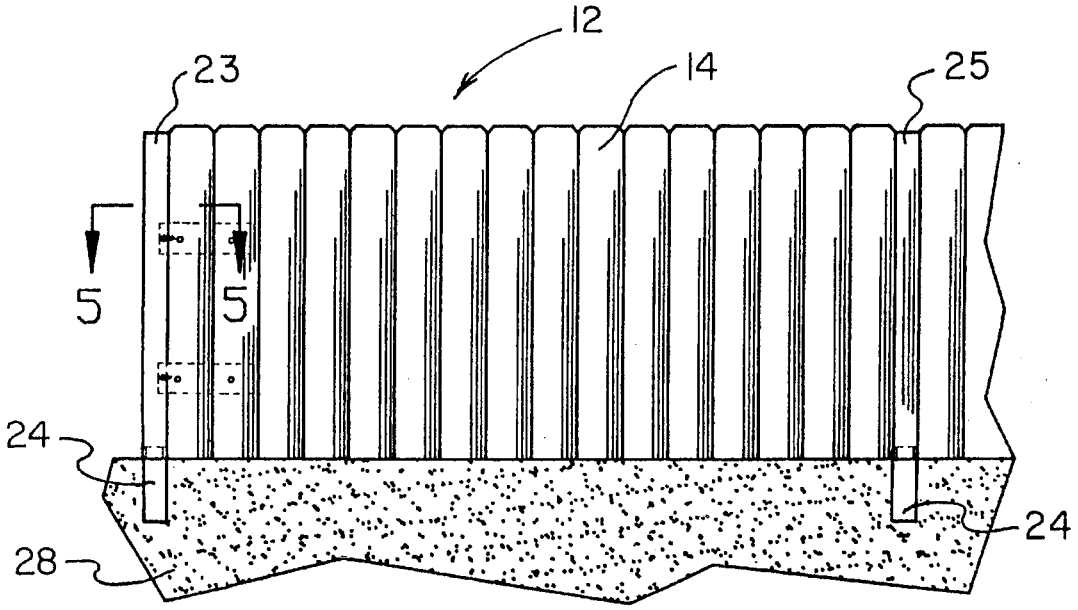
FIG. 4 is a side view of a second embodiment of the invention wherein the corner joint unit also serves as a fence post.
Figure 7:
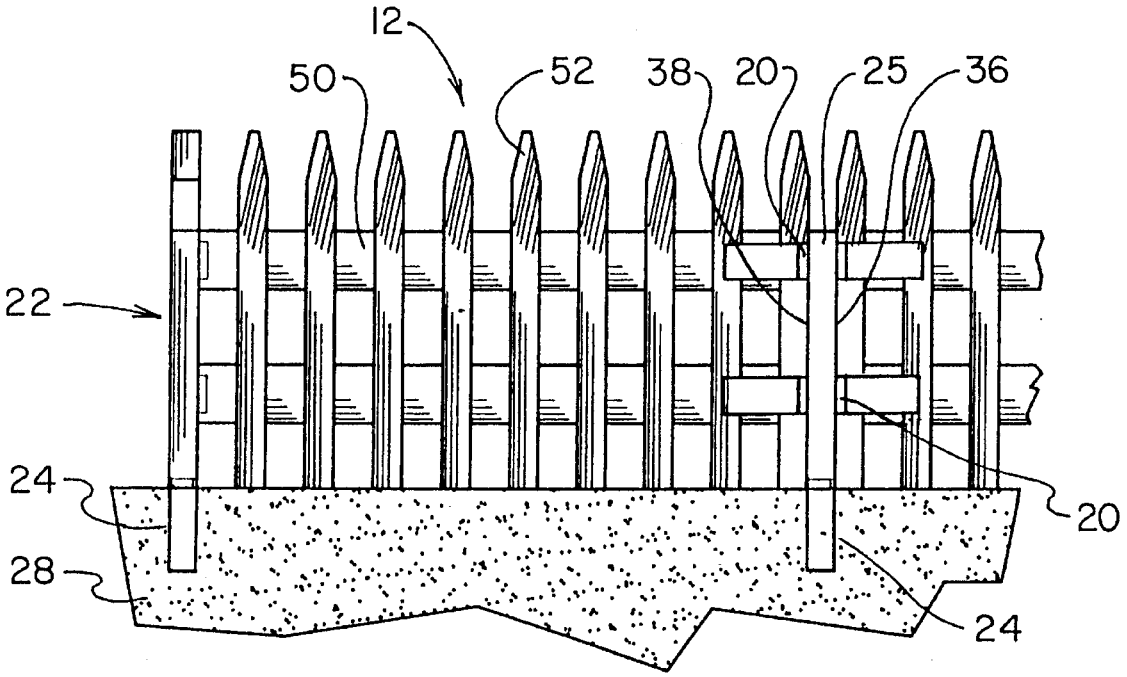
FIG. 7 is a side view of a fourth embodiment of the modular fence apparatus of the invention in which fence posts are housed within both corner joint units and straight joint units, and wherein the fence modules simulate a picket fence.

As shown in FIGS. 4 and 7, the joint assemblies 22 include straight joint assemblies 25 in which connector elements 20 project from a first side 36 of the straight joint assemblies 25 at a straight angle with respect to connector elements 20 which project from a second side 38 of the straight joint assemblies 25.

Figure 6:
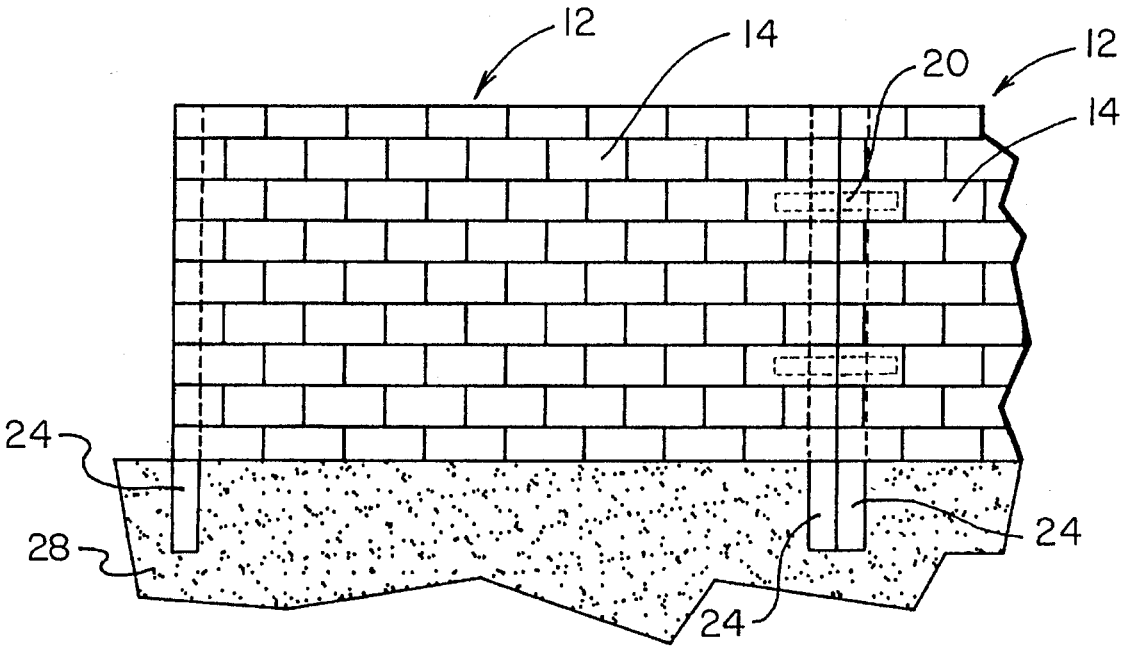
FIG. 6 is a side view of a third embodiment of the modular fence apparatus of the invention in which fence posts are housed within hollow fence modules which are in the form of simulated brick walls.

As shown in FIGS. 1–5, the ornamental exterior surface 14 simulates vertically oriented wooden boards. As shown in FIG. 6, the ornamental exterior surface 14 simulates a brick wall. As shown in FIG. 7, the ornamental exterior surface 14 simulates a picket fence. In the picket fence shown, the hollow fence modules 12 contain horizontal rails 50 and vertical pickets 52.

As shown in FIGS. 1–3, the fence post assemblies 24 are comprised of metal posts 24 that are placed external to the hollow fence modules 12. The metal posts 24 include apertures, and the hollow fence modules 12 includes apertures that are placed in registration with the apertures on the metal posts 24. Then fasteners are placed through the registered apertures to secure the external metal posts 24 to the hollow fence modules 12.

As shown in FIG. 6, the fence post assemblies 24 are contained internally within a hollow interior of the hollow fence modules 12.

Although the dimensions of the hollow fence modules 12, the joint assemblies 22, and the fence post assemblies 24 can be of any desired sizes, convenient dimensions are as follows. For a privacy fence that has an ornamental exterior surface 14 that simulates vertical boards such as shown in FIG. 1, the length of the hollow fence modules 12 can be approximately 8 feet, and their height can be approximately 6.5 feet. Similarly, for a privacy fence that has an ornamental exterior surface 14 that simulates a brick wall such as shown in FIG. 6, the length of the hollow fence modules 12 can be approximately 8 feet, and their height can be approximately 6.5 feet. For a fence that resembles a picket fence such as shown in FIG. 7, the length of the hollow picket fence modules 12 is approximately 8 feet, and their height can be approximately 44 inches. The hollow fence modules 12 can also be used as walls in utility storage sheds. For such walls, the length of the hollow fence modules 12 can be approximately 8 feet, and the height can be approximately 8 feet.

In use, fence post assemblies 24 can be driven into the ground 28. When the fence post assemblies 24 are external to the hollow fence modules 12, such as shown in FIG. 1 for fence post assemblies 24 separated from joint assemblies 22 and such as shown in FIG. 4 for fence post assemblies 24 contained in joint assemblies 22, the fence post assemblies 24 are driven into the ground. Then the hollow fence modules 12 are connected to them.

On the other hand, when the fence post assemblies 24 are contained internally in the hollow interior of the hollow fence modules 12 such as shown in FIG. 6, the fence post assemblies 24 are driven into the ground 28 when the hollow fence modules 12 are placed in their proper position.

The plastic materials that form the components of the modular fence apparatus of the invention can be well known plastic materials used in plastic fence components disclosed in the above-cited U.S. Pat. Nos. 4,070,007, 4,357,000, 4,477,058, 4,553,741, and 4,722,514, incorporated herein by reference.

The components of the modular fence apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved modular fence apparatus that is low in cost, relatively simple in design and operation, and which may advantageously be used to provide a privacy fence without requiring the installation of large numbers of closely spaced individual components. With the invention, a modular fence apparatus is provided which is not made of wood and is not subjected to swelling and shrinking due to moisture and temperature changes such that the privacy established by a privacy fence is not compromised. With the invention, a modular fence apparatus is provided which is made of a material other than wood or brick but simulates the appearance of wood or brick. With the invention, a modular fence apparatus is provided which is made from hollow materials that have a simulated wood or simulated brick outer surface. With the invention, a modular fence apparatus is provided which employs connection devices between the vertical fence posts and the horizontal boards that are substantially hidden from view. With the invention, a modular fence apparatus is provided which uses only a relatively small number of vertically oriented fence posts yet gives the appearance of employing a large number of vertically oriented boards. With the invention, a modular fence apparatus is provided which eliminates a plurality of horizontal rails for supporting a plurality of vertical boards. With the invention, a modular fence apparatus is provided which facilitates connection of a vertical board to a vertical fence post. With the invention, a modular fence apparatus provides components that can be used as walls of a utility shed. With the invention, a modular fence apparatus provides components that can be used in the building of picket fences.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved fence apparatus, comprising:

a plurality of hollow fence modules made of plastic material, each of hollow fence modules formed as a potion of a wall which prevents viewing through said hollow fence module, said hollow fence modules including an ornamental exterior surface, said hollow fence modules including module slots at edge portions of said hollow fence modules, a plurality of joint assemblies adapted to be interconnected between two adjacent hollow fence modules, said joint assemblies including joint assembly slots and connector elements secured within said joint-assembly slots, said connector elements adapted to be received in said module slots said two adjacent hollow fence modules for joining said two adjacent hollow fence modules together, and a plurality of fence post assemblies for securing said hollow fence modules to a portion of a ground, said fence post assemblies being integrally formed with said joint assemblies and connected to said hollow fence modules, wherein said connector elements are adapted to be received in said module slots of said hollow fence modules and in said joint-assembly slots of said joint assemblies, wherein said connector elements include first channels, wherein said edge portions of said hollow fence modules include second channels which are capable of being placed in registration with said first channels, and wherein fasteners are placed through said registered first channels and said second channels and are employed to secure said hollow fence modules to said joint assemblies.

2. The apparatus described in claim 1 wherein said connector elements fit into said joint-assembly slots in said joint assemblies.

3. The apparatus described in claim 1 wherein:

said joint include corner joint assemblies in which said connector elements project from a first side of said corner joint assemblies at a right angle with respect to said connector elements which project from a second side of said corner joint assemblies.

4. The apparatus described in claim 1 wherein:

said joint assemblies include straight joint assemblies from which said connector elements project from a first side of said straight joint assemblies at a straight angle with respect to said connector elements which project from a second side of said straight joint assemblies.

5. The apparatus described in claim 1 wherein said ornamental exterior surface simulates vertically oriented wooden boards.

6. The apparatus described in claim 1 wherein said ornamental exterior surface simulates a brick wall.

7. The apparatus described in claim 1 wherein said fence post assemblies are comprised of metal posts that are placed external to said hollow fence modules.

8. The apparatus described in claim 1 wherein said fence post assemblies are contained internally within a hollow interior of said hollow fence modules.

* * * * *